US010113120B2

(12) United States Patent
Nes et al.

(10) Patent No.: US 10,113,120 B2
(45) Date of Patent: Oct. 30, 2018

(54) PROCESSING FLUID FROM A WELL

(75) Inventors: Hroar Andreas Nes, Trondheim (NO); Rainer Josef Hoffmann, Unterhaching (DE); Knut Arild Maråk, Trondheim (NO); Stig Goplen, Hosle (NO)

(73) Assignee: STATOIL PETROLEUM AS, Stavanger (NO)

( * ) Notice: Subject to any disclaimer, the term of this patent is extended or adjusted under 35 U.S.C. 154(b) by 286 days.

(21) Appl. No.: 14/428,302

(22) PCT Filed: Sep. 14, 2012

(86) PCT No.: PCT/EP2012/068170

§ 371 (c)(1),
(2), (4) Date: Mar. 13, 2015

(87) PCT Pub. No.: WO2014/040648

PCT Pub. Date: Mar. 20, 2014

(65) Prior Publication Data

US 2015/0232766 A1 Aug. 20, 2015

(51) Int. Cl.
*C10G 31/06* (2006.01)

(52) U.S. Cl.
CPC ..... *C10G 31/06* (2013.01)

(58) Field of Classification Search
CPC ..... C10G 31/06; E21B 21/06; E21B 36/00; E21B 36/001; E21B 36/005; E21B 36/04; F28F 19/00; F28G 13/00; F28D 7/10; F28D 7/16; B08B 9/027
See application file for complete search history.

(56) References Cited

U.S. PATENT DOCUMENTS

| | | | |
|---|---|---|---|
| 2,303,823 | A | 12/1942 | Coberly |
| 3,213,834 | A | 10/1965 | Heathcote et al. |
| 3,454,464 | A | 7/1969 | Tuggle et al. |
| 4,143,702 | A | 3/1979 | Barr, Jr. |
| 4,577,677 | A | 3/1986 | Ezzell |

FOREIGN PATENT DOCUMENTS

| | | | |
|---|---|---|---|
| DE | 33 28 311 | A | 2/1985 |
| JP | 02-136573 | A | 5/1990 |
| WO | WO 2009/051495 | A1 | 4/2009 |

*Primary Examiner* — Prem C Singh
*Assistant Examiner* — Brandi M Doyle
(74) *Attorney, Agent, or Firm* — Birch, Stewart, Kolasch & Birch, LLP

(57) ABSTRACT

Methods and apparatus for processing fluid from a well are described. A first wall portion may define a first region and a second wall portion may define a second region, fluid from said well being let through those regions. Heating of said first wall portion may be performed to release wax from said first wall portion into said fluid at said first flow region. During said heating, cooling of said fluid at said second flow region may be performed to cause wax from said fluid to deposit on said second wall portion.

27 Claims, 4 Drawing Sheets

PROCESSING FLUID FROM A WELL

TECHNICAL FIELD

The present invention relates to methods and apparatus in particular for processing fluid from a well, in particular to prepare the fluid for long distance pipeline transport.

BACKGROUND

Equipment carrying fluid from one location to another can be susceptible to fouling by wax. A layer of wax may deposit on walls facing the space inside the equipment in which such fluid is carried. Deposition of wax can be a particular problem in the oil and gas production industry, where wax may precipitate from a fluid from a well as it is carried through a pipeline away from the well and is cooled. In a subsea location, for example, the fluid from the well may have a temperature near the well head of around 80 to 120 degrees Celsius and may cool by transfer of heat via the walls of the pipe to the surrounding seawater to a temperature close to the temperature of the seawater, as the fluid is conveyed through the pipe.

This can be a particular issue where the fluid from the well needs to be transported long distances to a downstream processing facility or where significant cooling may otherwise occur between the well head and such a facility.

Deposits of wax can cause pipeline blockage which is undesirable.

In order to avoid or reduce wax deposits on the inner surface of pipes, techniques have been developed that seek to keep the temperature of the fluid above the threshold temperature at which wax precipitates from the particular fluid concerned i.e. the "Wax Appearance Temperature" of the fluid, all the way to the processing facility. Such techniques involve applying insulation and/or electrical heating to sections of the pipeline to keep the fluid sufficiently warm. However, techniques of applying insulation and/or heating may have drawbacks in terms of logistics and/or cost particularly where a pipeline is to extend large distances.

Solutions have been proposed in which the flow of fluid from the well is conditioned near the well head by deliberately generating wax which is then released from the wall and carried in the fluid in the form of wax particles, in a so-called "cold flow", to a downstream facility. Once the wax is produced and then released into the fluid to form the cold flow, the wax is stabilized and tends not to deposit on the walls of the pipeline.

One such cold flow technique is described in the PCT patent publication WO2009/051495. In this technique, oil from a well may be cooled to a low temperature close to the ambient sea temperature (Tlow>Tsea) in a designated conditioner section of the pipeline and wax is allowed to form on the pipeline inner wall. Once in a while, the pipeline wall may be heated by application of a pulse of heat to the wall of the pipe. The heat pulse will melt a very thin layer of the wax at the wax/wall interface. The flow of oil in the pipeline will then tear the layer of wax off the wall, releasing it in solid form into the fluid. In this way, the wax, at least to the extent it is not melted by heating the wall, is stabilized and does not turn back to its original form after release from the heated wall so that it can travel in the oil over a long distance without re-depositing.

SUMMARY OF THE INVENTION

The inventors have noted potential improvements to the cold flow technique as described in for example WO2009/051495. For example, some of the deposited wax at the interface of the wax deposit with the pipe wall, may melt upon applying heat to the wall of the pipe. Any such melted wax may re-mix with the oil, and may eventually deposit at a location of the pipeline further downstream upon cooling.

Further, the heating period required to release wax into the flow may last for several hours and may be required to be applied at a frequency of around once per week, depending on the oil. During the heating period, the pipeline fluid will not be subjected to cooling (i.e. deliberate wax formation) in the designated conditioner section, and the oil will simply pass through that section without cooling and into the pipeline. Eventually, at some point along the pipeline downstream, the oil may cool and wax may deposit on a wall inside the pipeline. The pipeline may then require a removal operation such as pigging to remove the deposit at the relevant location.

Furthermore, the length of pipe section in which the flow is conditioned by cooling and application of heat pulses may depend on the fluid temperature, the wax appearance temperature of the fluid, pipe diameter and the heat transfer conditions in the pipe section. The length of this section can be significant, for example of the order of a few kilometres.

According to a first aspect of the invention there is provided apparatus for processing fluid from a well as set out in the claims appended hereto.

According to a second aspect of the invention there is provided a method of processing fluid from a well as set out in the claims appended hereto.

Each and any of the above aspects may include further features, as set out in the claims appended hereto or in the present description.

It will be appreciated that features mentioned in relation to any of the above aspects, whether in the claims or in the description, may be combined with each other, between the different aspects.

DESCRIPTION OF THE INVENTION

There will now be described, by way of example only, embodiments of the invention with reference to the accompanying drawings, in which.

Figure 1:
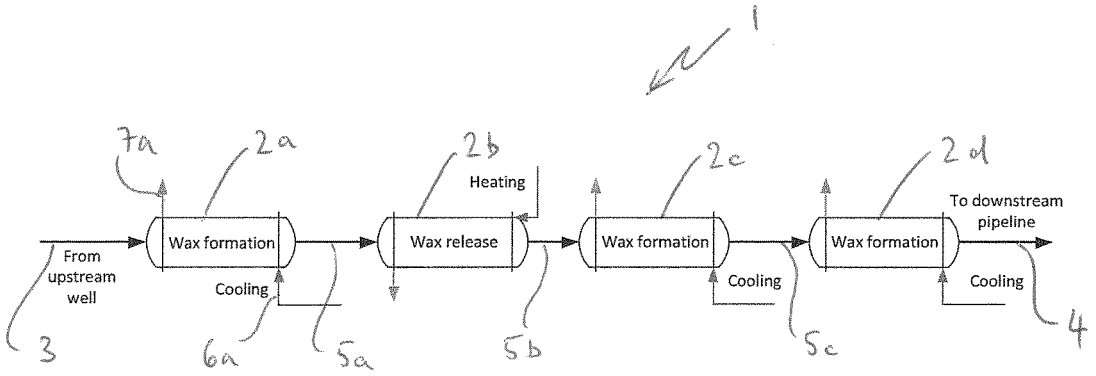
FIG. 1 is a representation of apparatus for conditioning fluid from a well in accordance with an embodiment of the invention.

With reference firstly to FIG. 1, the apparatus for conditioning fluid from the well is generally depicted at reference numeral 1. The fluid may comprise hydrocarbons such as oil and gas. The apparatus 1 in this example has four conditioners in the form of heat exchange devices 2*a*-2*d*, arranged in series. The apparatus 1 may be arranged subsea near a well head, so as to receive a flow of fluid from a well through an upstream pipe section 3. The fluid passes through the apparatus 1 and into a downstream pipe section 4. The apparatus 1 acts to condition the fluid contained in the flow, producing conditioned fluid. The downstream pipe section 4 is connected to a transport pipeline for transporting the conditioned fluid downstream to a processing facility (not shown).

The fluid from the well passes through each of the heat exchange devices 2*a*-2*d* between the upstream and downstream pipe sections 3, 4. Thus, each device has an outlet and inlet for fluid and a flow region defined therein and extending between the inlet and outlet, for the fluid to pass through the device. Typically, the device comprises a pipe having a pipe wall which defines the flow region therein. As can be seen in FIG. 1, the outlet and inlet of successive devices are connected to each other by pipe sections 5*a*-5*c*. For example, the heat exchange device 2*a* is located upstream of device 2*b*, and the outlet of device 2*a* is fluidly connected via pipe section 5*a* to the inlet of heat exchange device 2*b*. Thus, the apparatus is arranged such that fluid from the well flows first into heat exchange device 2*a*, then out of the outlet of device 2*a*, through pipe section 5*a* and into the inlet of exchange device 2*b*.

In this way, the whole flow in the upstream pipe section 3 may be directed serially through each of the heat exchange devices into the downstream pipe section 4.

Each heat exchange device 2*a*-2*d* can be used for cooling the fluid contained in the flow region inside the device, in order to cause wax to precipitate from the fluid and be deposited on the wall surface adjacent the flow region. The heat exchange device may comprise a pipe for carrying the fluid from the well and may have a heat exchange chamber surrounding the pipe for receiving a cooling fluid in order to cool the fluid from the well. More specifically, the chamber may be provided with a cold, cooling fluid which is passed through the chamber such that heat from the fluid contained inside the pipe is transferred across the wall of the pipe into the cooling fluid, resulting in cooling of the fluid from the well and production of wax onto the surface. The chamber may have an inlet and outlet for fluid, such that fluid can be circulated therethrough. For example, the first device 2*a* shown in FIG. 1 has an inlet 6*a* and an outlet 7*a* for fluid to enter and exit the heat exchange chamber. Each of the other devices 2*b* to 2*d* may have a like inlet and outlet.

Each heat exchange device 2*a*-2*d* may also be used for heating the surface on which wax is deposited, in order to release previously deposited wax from that surface. The heat exchange devices are typically configured to operate alternately to perform cooling or heating. The heating may be performed by circulating a hot or heated fluid (having a temperature higher than the fluid in the flow region) through the heat exchange chamber to heat the wall of the pipe. Alternatively, an electrical heating means could be provided to supply heat to the pipe wall.

Each heat exchange device 2*a*-2*d* may take the form of a tube-and-shell heat exchanger which may comprise straight tubes or tubes with sections bent back on each other or coiled, though which fluid from the well may be passed through the device between an inlet and outlet of the tube. The tube may be located within an outer shell defining the heat exchange chamber between the shell and the wall of the tube for receiving cooling or heating fluid. This arrangement helps to provide a high surface area for heat transfer between the well fluid inside the tube and the cooling or heating fluid surrounding the tube.

Alternatively, the device may comprise a pipe-in-pipe arrangement where fluid from the well is conveyed through an inner pipe defining the flow region therein, and an outer pipe is provided around the inner pipe defining in effect a heat exchange chamber in the region between the inner and outer pipes. The outer pipe may have open ends, and the device may be arranged to direct seawater into one end, through the region defined between the pipes, and out of the other end, such that the seawater provides cooling of the fluid contained inside the inner pipe.

In practice, the apparatus is used to produce wax and cause wax to be deposited on an inside wall between the upstream and downstream pipe sections. The apparatus is further used to release the deposited wax intermittently into the fluid to form a stabilised flow, i.e. containing stabilised wax, which enters into the downstream pipe section 4.

The heat exchange devices are configured to cooperate so that when wax is being released at one of the devices, cooling is provided by another. This is done to ensure that the fluid is properly conditioned with wax put into solid, stabilized form before entering the downstream section 4. Thus, it reduces the possibility of fluid entering the downstream section 4 without stabilising wax, and of fouling the pipeline further downstream during periods of heating.

Typically, each device is operated periodically in heating or cooling mode. In FIG. 1, the apparatus 1 is shown during operation with the devices 2*a*, 2*c* and 2*d* in cooling mode in order to stabilise and produce wax, whilst device 2*b* is in heating mode to release stabilised wax from the wall.

The fluid received in device 2*b* from the upstream device 2*a* comprises treated fluid from which wax has been stabilised and deposited (at device 2*a*). At device 2*b*, during the period of heating, wax is released into the treated fluid from device 2*a*. Devices 2*c* and 2*d* provide further cooling of the fluid to help remove and stabilise wax.

Once wax has been released into the fluid at device 2*b*, this device may be switched to cooling mode to generate a fresh deposit of wax therein, whilst another device for example device 2*c*, is switched to heating mode to release deposited wax in that device.

The sequence and operation of the devices in heating or cooling modes may be controlled according to a computer program, or according to the level of wax build up in different devices.

In certain embodiments, the heat exchange devices may be piggable in order to remove any wax deposited inside those devices. The apparatus could have a pigging device for launching pigs into the devices and/or pipeline to inspect and clean the apparatus internally during operation and remove wax.

Figure 2:
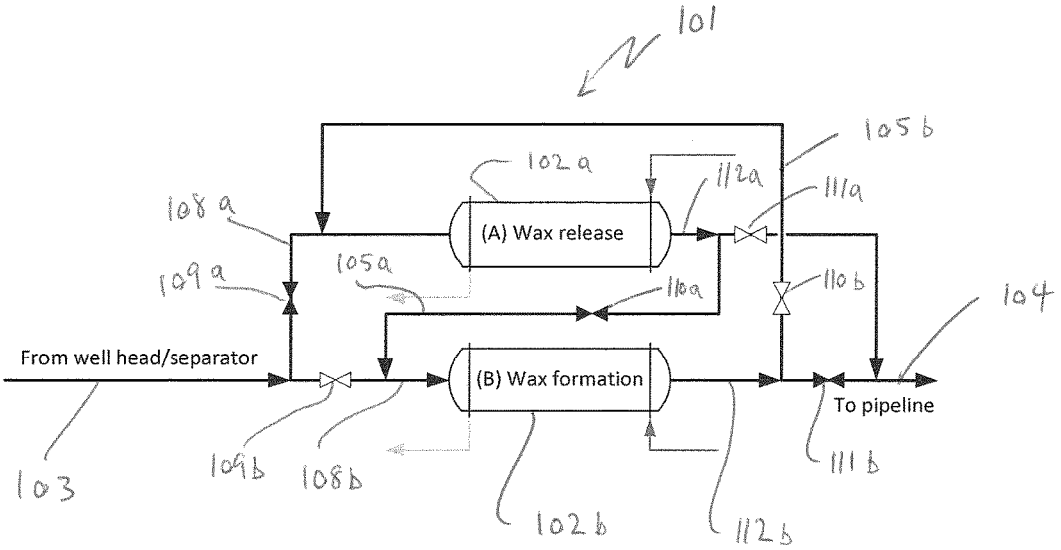
FIG. 2 is a representation of apparatus for conditioning fluid from a well according to another embodiment of the invention.

In FIG. 2, a second apparatus 101 is shown. Reference numerals as those of FIG. 1 but incremented by one hundred are used in FIG. 2 to denote like features to those of the apparatus of FIG. 1. In FIG. 2, two conditioners 102*a*, 102*b* are used where one of the devices performs cooling to deposit stabilized wax whilst the other device releases deposited wax. Here, the apparatus is shown during operation with the conditioner 102*b* in cooling mode and the conditioner 102*a* in heating mode.

The flow of fluid in the upstream section 103 can be directed in whole to either of the devices 102*a* and 102*b* via inlet pipe sections 108*a*, 108*b* by use of controllable flow valves 109*a*, 109*b* on the respective inlet pipe sections 108*a*, 108*b*. Note that the non-solid flow valve symbol (c.f. valve 109*b*) denotes an open valve through which fluid may flow, whilst the solid valve symbol (c.f. valve 109*a*) denotes a closed valve through which fluid may not flow.

The devices 102*a* and 102*b* are also connected to each other so that the outlet of either device is connected through connecting sections 105*a*, 105*b* to the inlet of the other. Flow of fluid out of each of the devices 102*a*, 102*b* can be directed through either of the connecting sections by use of controllable valves 110*a*, 110*b* on the respective connecting sections 105*a*, 105*b*, and controllable flow valves 111*a*, 111 *b* on outlet pipe sections 112*a*, 112*b* which lead out of the respective devices 102, 102*b*.

During a first phase of operation of the apparatus as shown in FIG. 2, valve 109*a* is closed and valve 109*b* is open such that fluid from the well enters into the heat exchange device 102*b* in which the fluid is cooled. Wax is deposited on the wall portion defining the flow region inside the device 102*b*. Treated fluid exits the device 102*b* through outlet pipe section 112*b*. The valve 111*b* is closed and valve 110*b* is open, to direct fluid through connecting section 105*b* and into the inlet of the device 102*a*. The wall portion defining the flow region for fluid inside the device 102*a* is heated to release deposited wax from the wall into the treated fluid from device 102*b*. It will be noted that the deposited wax may have deposited from an earlier operational phase of the apparatus during which the device 102*a* was operated in cooling mode. The fluid exits the device 102*a* through outlet pipe section 112*a*. The flow valve 111*a* is open and 110*a* is closed such that fluid is directed onwards into the downstream pipe section 104.

It will be appreciated that once wax has been removed from 102*a* and it is desired to release wax from 102*b*, the device 102*a* may be switched to cooling mode, and device 102*b* switched to heating mode. The apparatus may then enter a second phase of operation (not shown), where the valves are switched to their opposite state (open or closed). In the second phase, the apparatus may operate in the same way as in the first phase, but with the heating or cooling role of the devices 102*a* and 102*b* swapped. In outline, the fluid from the well will enter in whole into the device 102*a* and progress through connecting section 105*a* into the inlet of device 102*b* and through outlet section 112*b* and valve 111*b* to the downstream pipeline 104.

In this way, the fluid that is used to tear off wax from the wall portion inside the relevant device 102*a*, 102*b*, previously has been treated and cooled to Tlow and wax stabilized.

Figure 3:
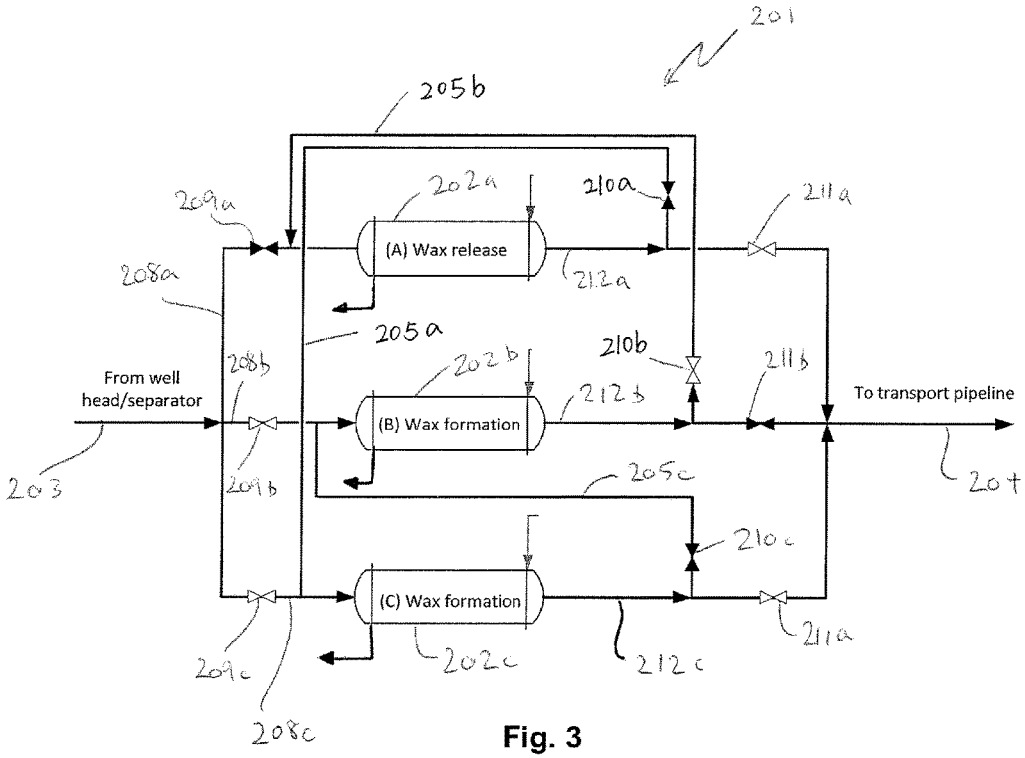
FIG. 3 is a representation of apparatus for conditioning fluid from a well according to another embodiment of the invention.

Turning now to FIG. 3, there is shown apparatus 201 for conditioning a flow of fluid from a well. The same reference numerals to those of FIG. 2 but incremented by one hundred are used in FIG. 3 to denote like features to those of the apparatus of FIG. 2. In this example, three conditioners 202*a*, 202*b* and 202*c* are used. Fluid from the well is split into selected devices. In the operational phase shown in FIG. 3, fluid from the well enters into the heat exchange devices 202*b* and 202*c*. Valves 209*a*-209*c* provided on inlet pipe sections 208*a*, 208*c* are used to direct the fluid into the appropriate conditioners. As indicated, the valve 209*a* is closed, and valves 209*b* and 209*c* are open.

The devices 202*a*, 202*b* and 202*c* are connected to each other so that:

1) the outlet of device 202*a* is connected through connecting pipe section 205*a*, to the inlet of the device 202*c;*
2) the outlet of device 202*b* is connected through connecting pipe section 205*b*, to the inlet of device 202*a*; and
3) the outlet of device 202*c* is connected through connecting pipe section 205*c* to the inlet of device 202*b*.

Flow of fluid out of each of the devices 202*a*, 202*b* and 202*c* can be selectively directed through the connecting sections 205*a*-205*c* by use of controllable valves 210*a*-210*c* on the respective connecting sections 205*a*-205*c* and controllable flow valves 211*a*-211*c* on outlet pipe sections 212*a*-212*c* which lead out of the respective devices 202*a*-202*c*.

The heat exchange devices 202*b* and 202*c* act to cool the fluid received in the flow regions thereof. This generates wax and causes deposition of the wax on the wall adjacent to the fluid received therein. Treated fluid is produced from each of these devices. The treated fluid from the heat exchange device 202*c* flows along a first flow path through valve 211*a* directly into the transport pipeline 204, valve 210*c* being closed and valve 211*a* being open. The treated fluid from the heat exchange device 202*b* flows along a second, different flow path through valve 210*b* and connecting section 205*b* into the exchange device 202*a*, valve 210*b* being open and valve 211*b* being closed. The heat exchange device 202*a* acts to heat a wall therein on which wax is deposited, to release the deposited wax from the wall. Such wax may have been deposited in an earlier operational phase. The wax is released in solid and stabilised form into the treated fluid. The treated fluid with released wax flows out of the device 202*a* continuing along the second flow path through the valve 211*a* and pipe section 212*a* into the downstream pipe section 204, with valve 211*a* open and valve 210*a* closed.

It will again be appreciated that once wax has been removed from the device 202*a*, the apparatus may move to second and/or third phases of operation (not shown), where one of the devices 202*b* and 202*c* is used to perform heating to release wax, whilst the others are used to perform cooling.

In a second phase for example, the device 202*b* may perform heating, and fluid from the well enters into the devices 202*a* and 202*c*. Fluid from 202*a* is directed through valve 211*a* directly into the downstream pipe section 204 (valves 211*a* open and valve 210*a* closed). Treated fluid from device 202*c* is directed into the device 202*b* (valve 210*c* open, valve 211*c* closed) where it receives released wax, and the treated fluid and released wax flows out of the device 202*b* (valve 210*b* closed, valve 211*b* open) into the downstream pipe section 204.

In a third phase of operation of the apparatus, the device 202*c* may perform heating, and fluid from the well enters into the devices 202*a* and 202*b* (valve 209*a* and 20*b* open, valve 209*c* closed). Fluid from 202*b* is directed through valve 211*b* directly into the downstream pipe section 204 (valves 211*b* open and valve 210*b* closed). Treated fluid from device 202*a* is directed into the device 202*c* (valve 210*a* open, valve 211*a* closed) where it receives released wax, and the treated fluid and released wax flows out of the device 202*c* (valve 210*c* closed, valve 211*c* open) into the downstream pipe section 204.

Figure 4:
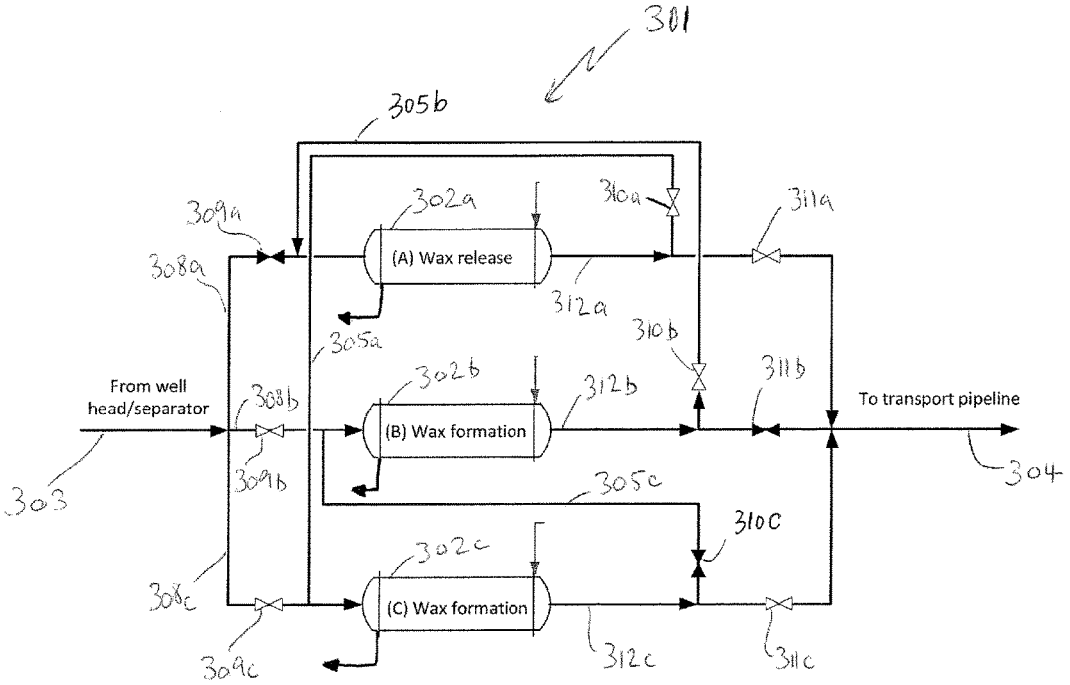
FIG. 4 is a representation of apparatus for conditioning fluid from a well according to yet another embodiment of the invention.

Turning now to FIG. 4 there is shown a yet further example apparatus 301 for conditioning a flow of fluid from a well. The same reference numerals to those of FIG. 3 but incremented by one hundred are used in FIG. 4 to denote like features to those of the apparatus of FIG. 3.

In this example, three conditioners 302*a*, 302*b* and 302*c* are used and are interconnected in the same way as the heat exchange devices 202*a*-202*c* of FIG. 3. However, in the first operational phase as shown in FIG. 4, a portion of the fluid from device used for heating flows through valve 310*a* and connecting pipe section 305*a* into the device 302*c* (valves 310*a* and valve 311*a* are open). This helps to solidify/stabilise and remove, by cooling in device 302*c*, any wax which may have melted and re-entered the fluid upon heating in the device 302*a*.

Similarly in the second operational phase (not shown) in which the heating is performed by device 302*b* (and the others cool), the valves 310*b* and 311 *b* are open to direct a portion of fluid from the device 302*b* into the device 302*a*. In the third operational phase (not shown) in which the heating is performed by device 302*c* (and the others cool), the valves 310*c* and 310*c* are open to direct a portion of fluid from the device 302*c* into the device 302*b*.

In a variant, valves 310*b* and valve 311*b* are open or part open in the first operational phase so that a portion of the fluid from the device 302*b* used for cooling flows through valve 310*b* and connecting pipe section 305*b* into the device 302*a*, whilst the rest of the fluid from device 302*b* goes directly to the pipeline 304. In the other operational phases, the cooling device upstream of the heating device may be configured equivalently by opening valves 310*a*, 311*a* or valves 310*c*, 311*c* to direct part of the flow from its outlet to the heating device and the rest directly to the pipeline.

In another embodiment using three heat exchange devices, the devices may be operated to direct fluid consecutively through the devices, along one flow path. In such an embodiment, using the reference numerals of FIG. 4, in a first operational phase, fluid is received in the device 302*c* from the well, valve 309*c* being open and valves 308*a* and 308*b* being closed. The device 302*c* is operated to perform cooling of the fluid. The device 302*b* receives fluid from the device 302*c* via connecting pipe 305*c*, valve 310*c* being open and valve 311*c* being closed. The device 302*b* is operated to heat the wall section adjacent to the fluid to release previously deposited wax into the fluid. The third device 302*a* in this example receives fluid from the device 302*b* via connecting pipe 305*b*, valves 310*b* being open and 311*b* being closed. The device 302*a* is operated to cool the fluid received therein. Fluid from the device 302*a* is directed via pipe 312*a* to an outlet of the apparatus, e.g. at the downstream pipe section 304 near the entrance to the transport pipeline, the valve 311*a* being open and valve 310*a* being closed.

The wall section in device 302*c* is cooled and does the bulk wax precipitation. The temperature of the fluid output from the device 302*c* does not need to be very close to the sea temperature (when the sea is providing the cooling). At the same time as releasing stabilized wax from the wall section in 302*b* into the fluid, the fluid will inevitably be modestly heated. In the device 302*a* which provides further cooling, only the non-stabilized wax will precipitate here and deposit on the wall section, whilst the rest (stabilized wax) will go to the pipeline.

In this example, the fluid from the well is subjected to devices operating in the sequence of cooling-heating-cooling. It will be appreciated that in other phases of operation, the heating can be performed by the device 302*a* or 302*c* with the others providing cooling. The valves can be operated accordingly to direct fluid firstly into one of the devices performing cooling, then into the device performing heating, and therefrom to another device performing cooling, in order to maintain the sequence. This sequence ensures that the fluid is always is released to the pipeline at the coldest achievable temperature. It can also help to reduce the equipment size, as the overall cooling is provided in two wall sections.

In the various embodiments described herein, the apparatus may operate in different operational phases, wherein in each such phase the heating and wax release is provided in a different device (heating phases). In practice, there may be a further operational phase in which all devices provide cooling (cooling phase). The apparatus may therefore be operable to change between any heating phase, as described above, and the cooling phase. Once all stabilized wax is removed in the device which is performing heating, it goes into cooling mode where all devices perform cooling. This cooling phase may in fact represent the usual mode of operation, in which the apparatus most of the time operates. After a period of time in the cooling phase, a heating phase is entered, in which heating is performed by one of the devices, typically a different device to that used for heating in the previous heating phase, where there may be a greater need for wax release. It may only be necessary to perform a heating for a short period of time (few hours) once or twice every month.

In the embodiments described, it will be appreciated that the fluid from the well may be conveyed along one or several flow paths between the upstream pipe section (inlet to apparatus) and the downstream pipe section (outlet). Such flow paths may be defined by the regions in which fluid is contained inside the devices. For example, in FIGS. 1 and 2, the heat exchange devices are arranged to receive fluid from the well at different locations along the same flow path; fluid passes successively from one device to the next. In FIGS. 3 and 4, a first portion of the fluid from the well is conveyed through the device 202*c*, 302*c* along one path, whilst a second portion of the fluid is conveyed through devices 202*a*, 302*a* and 202*b*, 302*b* along another path to the downstream pipe section. Thus, the devices may in certain embodiments be arranged at different locations and/or on different flow paths. FIG. 4 also provides an example of the fluid output from one device being divided and carried onward on two paths (e.g. through open valves 310*a* and 311*a*).

It may be noted that the precise distance of the apparatus from the well may be varied. However, if well stream temperature is high, there can be greater freedom to place the apparatus in a location at which the fluid temperature approaches the wax appearance temperature.

Figure 5:
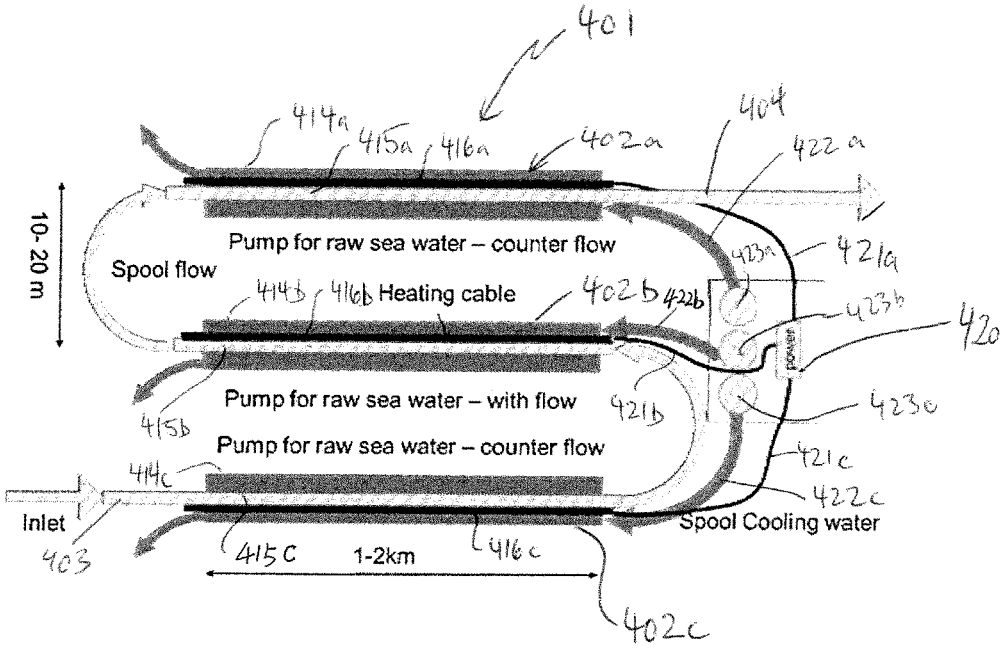
FIG. 5 is a representation of a layout of the apparatus with heat exchange devices as pipe-in-pipe segments in accordance with another embodiment of the invention.
Figure 6:
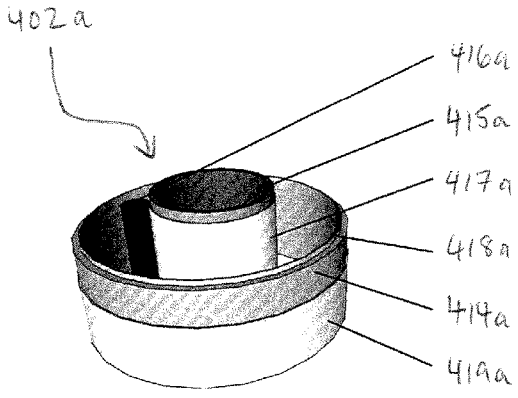
FIG. 6 is a representation of a section of one of the pipe-in-pipe segments for FIG. 5.

A practical layout example is shown in FIGS. 5 and 6 for a pipe-based wax control unit. The apparatus 402 comprises heat exchange devices 402*a-c*, for cooling and heating each in the form of pipe-in-pipe segments, each of length 1-2 km. Each pipe-in-pipe segment comprises an outer pipe 414*a-c*, which surrounds an inner pipe 415*a-c* defining an annular chamber therebetween. An electrical heating cable 416*a-c* for heating the wall of the inner pipe for releasing wax is provided along the wall of the inner pipe. Cooling is provided by pumping seawater, which may have a temperature of between 0 and 6 degrees Celsius at the seabed, through the annular chamber of the segment (surrounding the inner pipe). The cooling provided through these sections may stabilize the wax and fluid fully prior to the flow entering into the pipeline from the downstream pipe section 404, at which point the fluid temperature may be close to the seawater temperature. The apparatus has a power supply 420 for supplying power to each of the heating cables 416*a-c* via supply cabels 421*a-c*, and pumps 423*a-c* to take in and pump seawater via spools 422*a-c* through the annular chambers of the respective segments. As indicated in FIG. 6, each segment may also have a corrosion protective external cladding 417*a-c* applied around the outside of the inner pipe and a corrosion protective internal cladding 418*a-c* applied on the inside of the outer pipe. These claddings line the respective inner and outer pipes, to provide corrosion protection from fluid in the annular space between the inner and outer pipes. A protection and external corrosion coating 419*a-c* is applied to the outside of the outer pipes 414*a-c*.

In other variants, cooling and heating may be based on using conventional heat exchangers as heat exchange devices.

Pipe-in-pipe arrangements may typically be less complex compared to those using conventional heat exchangers and can be self-supporting. As can be seen in FIGS. 5 and 6, the pipe-in-pipe variant may use electrical cables (direct heating, induction heating, heat tracers) for providing the heat pulse. The pipe-in-pipe layout allows for pigging of the wax control unit itself.

Conventional heat exchangers may give a compact layout that can be installed on a supporting structure/template, and installation may be easier than for pipe-in-pipe segments. Application of a heat pulse by means of hot water circulation may be preferable in conventional heat exchangers.

Direct seawater cooling could be used for a pipe-in-pipe arrangement, as shown in FIG. 5, and is in general an efficient way to provide cooling. Indirect seawater cooling of a closed fresh water loop which in turn is in a heat exchange relationship with the hydrocarbon flow line is also a possibility and may reduce corrosion/material concerns which may be associated with direct cooling, particularly in the case of conventional heat exchangers.

There are a number of advantages to the present invention. The arrangements shown using a plurality of heat exchanger devices to provide cooling in one unit while heating to release wax is performed in another. This significantly reduces the non-stabilised wax content of the fluid entering into a transport pipeline. This provides maintenance and cost benefits. By operating heat exchange devices to perform both heating and cooling and doing so in parallel configurations, a significant reduction in non-stabilised wax content can be obtained over a limited distance from a well.

In arrangements using more than two devices less wax will enter the pipeline downstream. Such arrangements also provide useful operational redundancy, allow for smaller heat exchangers, and a reduced power demand and need for intervention and maintenance during operation.

Various modifications and improvements may be made without departing from the scope of the invention which is described herein. It can be noted for example that the apparatus may include more than three heat exchange devices, as many as desired, to provide good wax removal prior to said fluid entering a pipeline downstream for long distance transport.

The invention claimed is:

1. Apparatus for processing fluid from a well, the apparatus comprising:

a first wall portion adjacent a first region;

a second wall portion adjacent a second region;

said first and second regions arranged to let fluid pass therethrough;

the apparatus further comprising:

a first heat exchanger which includes said first wall portion, said first heat exchanger being arranged to heat said first wall portion to release wax from said first wall portion into said fluid at said first region; and a second heat exchanger which includes said second wall portion, said second heat exchanger being arranged in a first configuration to cool said fluid at said second region during said heating of the first wall portion to cause wax from said fluid to deposit on said second wall portion, wherein said second heat exchanger is operable in said first configuration to cool said fluid at said second region, and in a second configuration, different from said first configuration, to heat said second wall portion to release wax from the second wall portion into said fluid; and an outlet arranged to receive therein said fluid from said first and second regions, wherein the first heat exchanger and the second heat exchanger are disposed in a parallel configuration.

2. The apparatus as claimed in claim 1, wherein said second region is arranged to receive said fluid from the first region.

3. The apparatus as claimed in claim 1, wherein said first region is arranged to receive said fluid from the second region.

4. The apparatus as claimed in claim 1, arranged to switch between a first mode of operation in which said second region is arranged to receive said fluid from the first region and a second mode of operation in which said first region is arranged to receive fluid from said second region.

5. The apparatus as claimed in claim 1, further comprising a third wall portion adjacent a third region, the first, second and third regions being arranged to let said fluid pass therethrough, said outlet being arranged to receive said fluid from said first, second and third regions.

6. The apparatus as claimed in claim 5, wherein said second region is arranged to receive said fluid from the first region, and said third region is arranged to receive said fluid from said second region.

7. The apparatus as claimed in claim 5, wherein said first region is arranged to receive said fluid from said second region, and said third region is arranged to receive said fluid from said first region.

8. The apparatus as claimed in claim 1, wherein said first heat exchanger is operable in one configuration to perform said heating and in another configuration to cool said fluid to cause wax to deposit on said first wall portion.

9. The apparatus as claimed in claim 5, further comprising a third heat exchanger which includes said third wall portion, said third heat exchanger being configured to cool the well fluid at the third wall portion during heating of the first wall portion.

10. The apparatus as claimed in claim 9, wherein the third heat exchanger is operable in one configuration to perform said cooling at the third wall portion and in another configuration to heat said third wall portion to release wax from the third wall portion into the fluid.

11. The apparatus as claimed in claim 1, wherein: in a first mode of operation of the apparatus, said first heat exchanger is arranged to heat said first wall portion to release wax from the first wall portion into said fluid; and said second heat exchanger is arranged to cool said fluid to cause wax to deposit on said second wall portion.

12. The apparatus as claimed in claim 11, wherein:

in a second mode of operation of the apparatus, said first heat exchanger is arranged to cool said fluid to cause wax to deposit on said first wall portion; and said second heat exchanger is arranged to heat said second wall portion to release pre-deposited wax from the second wall portion into said fluid.

13. The apparatus as claimed in claim 9, wherein in a first mode of operation of the apparatus, said first heat exchanger is arranged to heat said first wall portion to release wax from the first wall portion into said fluid; and said second heat exchanger is arranged to cool said fluid to cause wax to deposit on said second wall portion and in both the first and second modes, the third heat exchanger is arranged to cool said fluid to cause wax to deposit on said third wall portion.

14. The apparatus as claimed in claim 12, wherein:

in a third mode of operation of the apparatus, said first and second heat exchangers are each arranged to cool said fluid to cause wax to deposit in respective first and second wall portions, and said third heat exchanger is arranged to heat said third wall portion to release wax into said fluid.

15. The apparatus as claimed in claim 11, wherein:

in a fourth mode of operation of the apparatus, each heat exchanger is arranged to cool the fluid to cause wax to deposit on the respective wall portions.

16. The apparatus as claimed in claim 12, arranged to be switched between any of:

i. the first and second modes of operation;

ii. the first and third modes of operation;

iii. the second and third modes; or iv. the fourth mode and any of the first to third modes.

17. The apparatus as claimed in claim 11, wherein in the first mode of operation, a first amount of said fluid is supplied from the first region to the third region, and a second amount of said fluid is supplied from the first region to the outlet.

18. The apparatus as claimed in claim 9, wherein the first, second and/or third heat exchangers comprises a first, second and/or third pipe which comprises said first, second and/or third wall portion, and wherein said first, second and/or third region is defined within said pipe.

19. The apparatus as claimed in claim 18, wherein said heat exchanger comprises a heat exchange chamber surrounding said pipe, said heat exchange chamber arranged to receive heat exchange fluid, for transferring heat across said wall portion between said fluid and the heat exchange fluid.

20. The apparatus as claimed in claim 19, comprising a shell surrounding said pipe to define said chamber.

21. The apparatus as claimed in claim 19, wherein in a cooling configuration, said heat exchange fluid comprises a coolant.

22. The apparatus as claimed in any of claims 19, wherein in a heating configuration, said heat exchange fluid comprises a heated fluid.

23. The apparatus as claimed in claim 21, wherein said coolant comprises seawater.

24. The apparatus as claimed in claim 1, arranged subsea.

25. The apparatus as claimed in claim 1, wherein said cooling is performed to cool said fluid to a temperature below a wax appearance temperature for said fluid.

26. The apparatus as claimed in claim 1, arranged to supply said fluid from the outlet into a subsea pipeline connecting the apparatus to a downstream facility.

27. A method of processing fluid from a well using the apparatus as claimed in claim 1, the method comprising:

a. providing the first heat exchanger which includes the first wall portion defining the first region, and the second heat exchanger which includes the second wall portion defining the second region, wherein the first heat exchanger and the second heat exchanger are disposed in a parallel configuration;

b. supplying said fluid through said first and second regions;

c. using the first heat exchanger to heat said first wall portion to release wax from said first wall portion into said fluid at said first region;

d. during the process of step c, using the second heat exchanger, in the first configuration, to cool said fluid at said second region to cause wax from said fluid to deposit on said second wall portion, wherein said second heat exchanger is operable in said first configuration to cool said fluid at said second region, and in the second configuration, different from said first configuration, to heat said second wall portion to release wax from the second wall portion into said fluid;

e. receiving said fluid from said first and second regions in an outlet.

* * * * *